US012448710B2

(12) United States Patent
Wang

(10) Patent No.: US 12,448,710 B2
(45) Date of Patent: Oct. 21, 2025

(54) PRECISE POSITIONING MECHANISM FOR AUTOMATIC HAT-MAKING PRODUCTION LINE EQUIPMENT

(71) Applicant: QINGDAO QIANFENG CAPART INT'L CORP, Qingdao (CN)

(72) Inventor: Aimei Wang, Qingdao (CN)

(73) Assignee: QINGDAO QIANFENG CAPART INT'L CORP, Qingdao (CN)

( * ) Notice: Subject to any disclaimer, the term of this patent is extended or adjusted under 35 U.S.C. 154(b) by 421 days.

(21) Appl. No.: 18/009,979

(22) PCT Filed: Mar. 23, 2022

(86) PCT No.: PCT/CN2022/082582
§ 371 (c)(1),
(2) Date: Dec. 12, 2022

(87) PCT Pub. No.: WO2022/222677
PCT Pub. Date: Oct. 27, 2022

(65) Prior Publication Data

US 2023/0228019 A1 Jul. 20, 2023

(30) Foreign Application Priority Data

Apr. 23, 2021 (CN) ..... 202110439088.7

(51) Int. Cl.
*D05B 3/06* (2006.01)
*D05B 35/12* (2006.01)

(52) U.S. Cl.
CPC ..... *D05B 3/06* (2013.01); *D05B 35/12* (2013.01); *Y10T 29/4978* (2015.01)

(58) Field of Classification Search
CPC .... D05B 3/06; D05B 35/12; D05B 2501/042; D05B 23/002; D05B 35/00; Y10T 29/4978
See application file for complete search history.

(56) References Cited

U.S. PATENT DOCUMENTS 5,996,961 A 12/1999 Johnson

FOREIGN PATENT DOCUMENTS

CN 205088508 U 3/2016
CN 108823819 A 11/2018
CN 208624722 U 3/2019
(Continued)

OTHER PUBLICATIONS

English Translation of CN_210826613_U (Year: 2020).*
English translation of CN_212611620_U (Year: 2021).*

*Primary Examiner* — Jacob J Cigna
(74) *Attorney, Agent, or Firm* — Bayramoglu Law Offices LLC

(57) ABSTRACT

A precise positioning mechanism for automatic hat-making production line equipment includes a rack, an installation seat, a jacking device, a positioning column, a material pickup and discharging platform, a support column, a guide rod, and an infrared ranging sensor. The material pickup and discharging platform is located at a top of one side of the rack. The installation seat is arranged on both sides of a bottom of the material pickup and discharging platform separately through bolts. The jacking device is arranged at a bottom of the installation seat of the material pickup and discharging platform through bolts. The positioning column corresponding to a position of the jacking device is inserted into both sides of a top of the material pickup and discharging platform separately. An output end of the jacking device and a bottom of the positioning column are connected through bolts.

10 Claims, 2 Drawing Sheets

(56) References Cited

FOREIGN PATENT DOCUMENTS

| | | | |
|---|---|---|---|
| CN | 209128690 | U | 7/2019 |
| CN | 210031108 | U | 2/2020 |
| CN | 110961800 | A | 4/2020 |
| CN | 210657447 | U | 6/2020 |
| CN | 210826613 | U | 6/2020 |
| CN | 212611620 | U | 2/2021 |
| CN | 113174705 | A | 7/2021 |
| JP | 2003326017 | A | 11/2003 |

* cited by examiner

PRECISE POSITIONING MECHANISM FOR AUTOMATIC HAT-MAKING PRODUCTION LINE EQUIPMENT

CROSS REFERENCE TO THE RELATED APPLICATIONS

This application is the national phase entry of International Application No. PCT/CN2022/082582, filed on Mar. 23, 2022, which is based upon and claims priority to Chinese Patent Application No. 202110439088.7, filed on Apr. 23, 2021, the entire contents of which are incorporated herein by reference.

TECHNICAL FIELD

The present disclosure relates to the technical field of hat making, and in particular, to a precise positioning mechanism for automatic hat-making production line equipment.

BACKGROUND

Hat sewing includes a process of buttonhole sewing, and whether a buttonhole sewing position is precise directly affects the beauty of the hat and the comfort of wearing.

During current hat sewing, there is a lack of a positioning mechanism that can help personnel or equipment to perform precise positioning and buttonhole processing, and a lack of components that can precisely adjust the working height of a processing platform when processing cloth with different thicknesses. In view of this, a precise positioning mechanism for automatic hat-making production line equipment is provided.

SUMMARY

An objective of the present disclosure is to provide a precise positioning mechanism for automatic hat-making production line equipment to solve problems in the above background art.

In order to achieve the above objective, the present disclosure provides the following technical solution: a precise positioning mechanism for automatic hat-making production line equipment includes a rack, an installation seat, a jacking device, a positioning column, a material pickup and discharging platform, a support column, a guide rod, and an infrared ranging sensor. The material pickup and discharging platform is located at a top of one side of the rack. The installation seat is arranged on both sides of a bottom of the material pickup and discharging platform separately through bolts. The jacking device is arranged at a bottom of the installation seat of the material pickup and discharging platform through bolts. The positioning column corresponding to a position of the jacking device is inserted into both sides of a top of the material pickup and discharging platform separately. An output end of the jacking device and a bottom of the positioning column are connected through bolts.

Further, the guide rod may be arranged on a periphery of the bottom of the material pickup and discharging platform through bolts, the support column may be arranged on both ends of the rack separately through bolts, and a guide hole corresponding to the guide rod may be formed at a top of the support column and a top of the rack separately.

Further, an installation groove may be formed at a top of the support column, the infrared ranging sensor may be provided in the installation groove through bolts, and cloth may be placed on the material pickup and discharging platform at the positioning column.

Further, a lead screw may be arranged at the bottom of the material pickup and discharging platform. A corresponding screw block may be threadedly sleeved on the lead screw. A servo motor may be arranged at a bottom end of the lead screw. A drive shaft at a top of the servo motor may be connected with a rotating shaft of the lead screw through an elastic coupling. A top of the lead screw may be rotatably connected with the bottom of the material pickup and discharging platform through a bearing. The servo motor and the screw block may be fixedly connected with the rack separately through bolts.

Further, the jacking device may be a pneumatic push rod or a hydraulic push rod.

A working method of the precise positioning mechanism for automatic hat-making production line equipment includes the following specific steps: step I: placing the material pickup and discharging platform on the rack of buttonhole process equipment of an automatic hat-making production line, and then fixing and installing the servo motor and the screw block at an inner top of the rack through bolts; step II: driving the lead screw to rotate through the servo motor to make the lead screw move up and down threadedly in the screw block to adjust a use height of the overall material pickup and discharging platform, such that the material pickup and discharging platform is suitable for buttonhole processing of cloth with various thickness specifications; step III: electrically connecting an electrical signal output terminal of the infrared ranging sensor with a control host of the production line, electrically controlling the jacking device and the servo motor by the control host, and calculating, by the control host, a ranging value transmitted by the infrared ranging sensor, such that through a number of rotations of the lead screw driven by the servo motor, the material pickup and discharging platform is capable of accurately moving to a required processing height; and step IV: placing cloth required for buttonhole processing on a side of the positioning column of the material pickup and discharging platform, and driving the positioning column to perform a jacking action by the jacking device before material discharging, such that the positioning column is jacked up, the cloth is perfectly inserted into the positioning column, precise positioning is completed, and an embroidered eye is more precise after the precise positioning.

Compared with the prior art, the present disclosure has the following beneficial effects: 1. the material pickup and discharging platform is placed on the rack of buttonhole process equipment of an automatic hat-making production line, and then the servo motor and the screw block are fixed and installed at an inner top of the rack through bolts. The lead screw is driven to rotate through the servo motor to make the lead screw move up and down threadedly in the screw block to adjust a use height of the overall material pickup and discharging platform, such that the material pickup and discharging platform is suitable for buttonhole processing of cloth with various thickness specifications.

2. An electrical signal output terminal of the infrared ranging sensor is electrically connected with a control host of the production line. The jacking device and the servo motor are electrically controlled by the control host. A ranging value transmitted by the infrared ranging sensor is calculated by the control host, such that through a number of rotations of the lead screw driven by the servo motor, the material pickup and discharging platform is capable of accurately moving to a required processing height. Cloth required for buttonhole processing is placed on a side of the positioning column of the material pickup and discharging platform, and the positioning column is driven to perform a jacking action by the jacking device before material discharging, such that the positioning column is jacked up, the cloth is perfectly inserted into the positioning column, precise positioning is completed, and an embroidered eye is more precise after the precise positioning.

Figure 1:
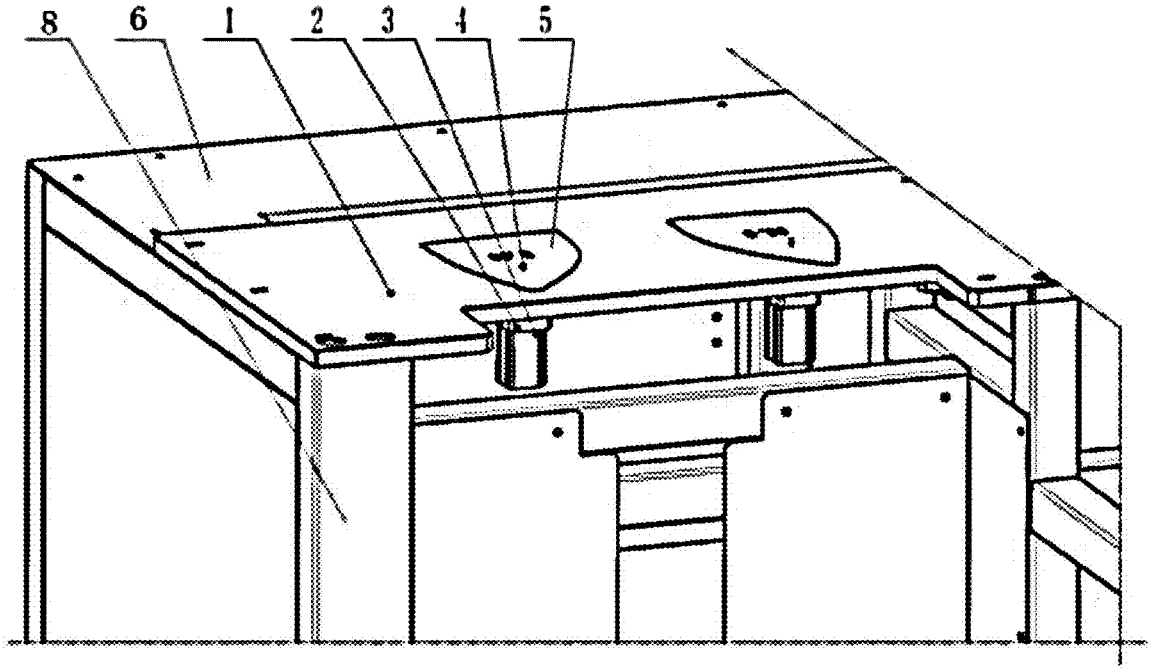
FIG. 1 is a schematic diagram of an overall structure of a precise positioning mechanism for automatic hat-making production line equipment according to the present disclosure.

Reference numerals: 1, a material pickup and discharging platform; 2, an installation seat; 3, a jacking device; 4, a positioning column; 5, cloth; 6, a rack; 7, a guide rod; 8, a support column; 9, a guide hole; 10, an installation groove; 11, an infrared ranging sensor; 12, a lead screw; 13, a screw block; 14, an elastic coupling; and 15, a servo motor.

DETAILED DESCRIPTION OF THE EMBODIMENTS

The technical solutions in the embodiments of the present disclosure will be described below clearly and completely with reference to the accompanying drawings in the embodiments of the present disclosure. Apparently, the described embodiments are merely some rather than all of the embodiments of the present disclosure. All other embodiments obtained by those of ordinary skill in the art based on the embodiments of the present disclosure without creative efforts shall fall within the protection scope of the present disclosure.

Figure 2:
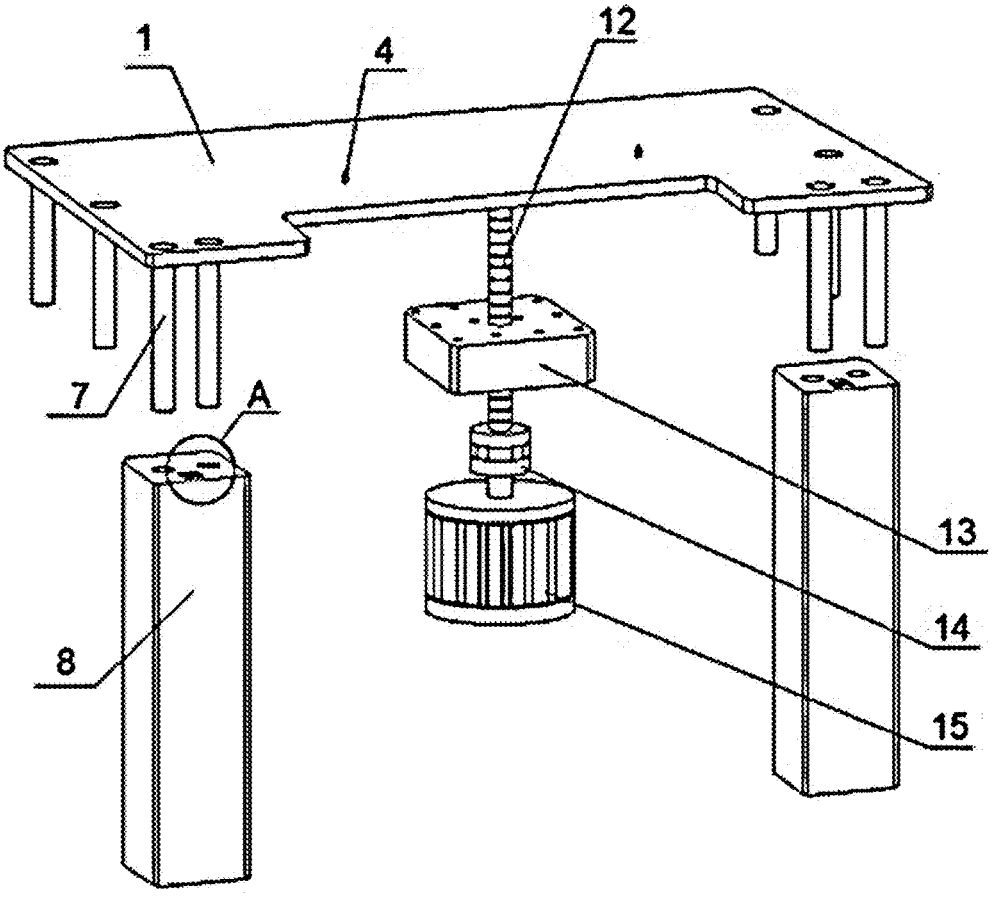
FIG. 2 is a schematic structural diagram of a material pickup and discharging platform of the precise positioning mechanism for automatic hat-making production line equipment according to the present disclosure.
Figure 3:
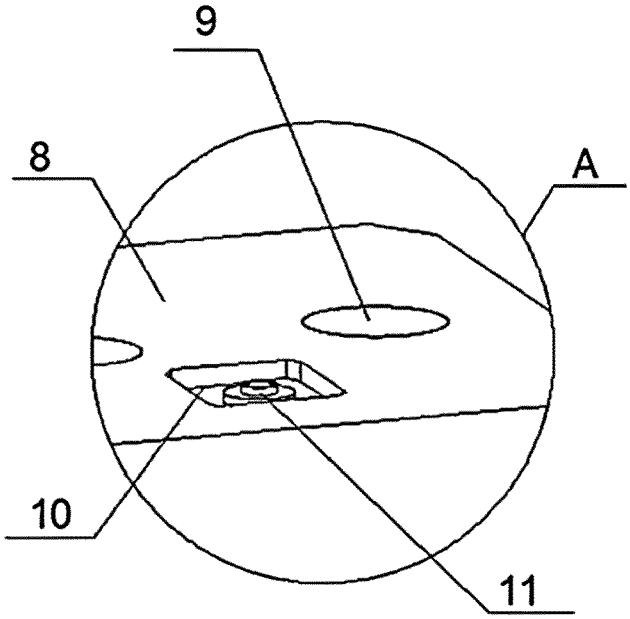
FIG. 3 is an enlarged view of A in FIG. 2 of the precise positioning mechanism for automatic hat-making production line equipment according to the present disclosure.
Figure 4:
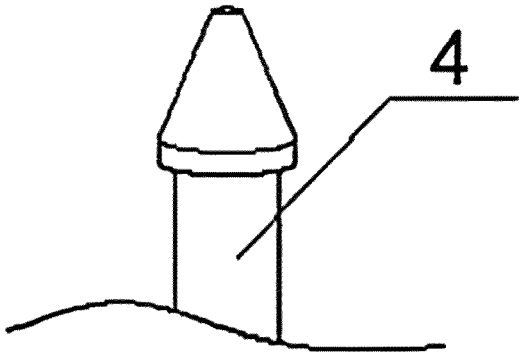
FIG. 4 is a schematic structural diagram of a positioning column of the precise positioning mechanism for automatic hat-making production line equipment according to the present disclosure.

As shown in FIG. 1 to FIG. 4, a precise positioning mechanism for automatic hat-making production line equipment includes a rack 6, an installation seat 2, a jacking device 3, a positioning column 4, a material pickup and discharging platform 1, a support column 8, a guide rod 7, and an infrared ranging sensor 11. The material pickup and discharging platform 1 is located at a top of one side of the rack 6. The installation seat 2 is arranged on both sides of a bottom of the material pickup and discharging platform 1 separately through bolts. The jacking device 3 is arranged at a bottom of the installation seat 2 of the material pickup and discharging platform 1 through bolts. The positioning column 4 corresponding to a position of the jacking device 3 is inserted into both sides of a top of the material pickup and discharging platform 1 separately. An output end of the jacking device 3 and a bottom of the positioning column 4 are connected through bolts.

The guide rod 7 is arranged on a periphery of the bottom of the material pickup and discharging platform 1 through bolts, the support column 8 is arranged on both ends of the platform 1 separately through bolts, and a guide hole 9 corresponding to the guide rod 7 is formed at a top of the support column 8 and a top of the platform 1 separately.

An installation groove 10 is formed at a top of the support column 8, the infrared ranging sensor 11 is provided in the installation groove 10 through bolts, and cloth 5 is placed on the material pickup and discharging platform 1 at the positioning column 4.

A lead screw 12 is arranged at the bottom of the material pickup and discharging platform 1. A corresponding screw block 13 is threadedly sleeved on the lead screw 12. A servo motor 15 is arranged at a bottom end of the lead screw 12. A drive shaft at a top of the servo motor 15 is connected with a rotating shaft of the lead screw 12 through an elastic coupling 14. A top of the lead screw 12 is rotatably connected with the bottom of the material pickup and discharging platform 1 through a bearing. The servo motor 15 and the screw block 13 are fixedly connected with the rack 6 separately through bolts.

The jacking device 3 is a hydraulic push rod.

A working method of the precise positioning mechanism for automatic hat-making production line equipment includes the following specific steps. Step I. the material pickup and discharging platform 1 is placed on the rack 6 of buttonhole process equipment of an automatic hat-making production line, and then the servo motor 15 and the screw block 13 are fixed and installed at an inner top of the rack 6 through bolts. Step II: the lead screw 12 is driven to rotate through the servo motor 15 to make the lead screw 12 move up and down threadedly in the screw block 13 to adjust a use height of the overall material pickup and discharging platform 1, such that the material pickup and discharging platform 1 is suitable for buttonhole processing of cloth with various thickness specifications. Step III: an electrical signal output terminal of the infrared ranging sensor 11 is electrically connected with a control host of the production line. The jacking device 3 and the servo motor 15 are electrically controlled by the control host. A ranging value transmitted by the infrared ranging sensor 11 is calculated by the control host, such that through a number of rotations of the lead screw 12 driven by the servo motor 15, the material pickup and discharging platform 1 is capable of accurately moving to a required processing height. Step IV: cloth required for buttonhole processing is placed on a side of the positioning column 4 of the material pickup and discharging platform 1, and the positioning column 4 is driven to perform a jacking action by the jacking device 3 before material discharging, such that the positioning column is jacked up, the cloth 5 is perfectly inserted into the positioning column 4, precise positioning is completed, and an embroidered eye is more precise after the precise positioning.

Working principle and use flow of the present disclosure: the material pickup and discharging platform 1 is placed on the rack 6 of buttonhole process equipment of an automatic hat-making production line, and then the servo motor 15 and the screw block 13 are fixed and installed at an inner top of the rack 6 through bolts. The lead screw 12 is driven to rotate through the servo motor 15 to make the lead screw 12 move up and down threadedly in the screw block 13 to adjust a use height of the overall material pickup and discharging platform 1, such that the material pickup and discharging platform 1 is suitable for buttonhole processing of cloth with various thickness specifications. An electrical signal output terminal of the infrared ranging sensor 11 is electrically connected with a control host of the production line. The jacking device 3 and the servo motor 15 are electrically controlled by the control host. A ranging value transmitted by the infrared ranging sensor 11 is calculated by the control host, such that through a number of rotations of the lead screw 12 driven by the servo motor 15, the material pickup and discharging platform 1 is capable of accurately moving to a required processing height. Cloth required for buttonhole processing is placed on a side of the positioning column 4 of the material pickup and discharging platform 1, and the positioning column 4 is driven to perform a jacking action by the jacking device 3 before material discharging, such that the positioning column is jacked up, the cloth 5 is perfectly inserted into the positioning column 4, precise positioning is completed, and an embroidered eye is more precise after the precise positioning.

Although the embodiments of the present disclosure have been illustrated and described, it should be understood that those of ordinary skill in the art may make various changes, modifications, replacements, and variations to the above embodiments without departing from the principle and spirit of the present disclosure, and the scope of the present disclosure is limited by the appended claims and their legal equivalents.

What is claimed is:

1. A positioning mechanism for automatic hat-making production line equipment, comprising a rack, an installation seat, a jacking device, a positioning column, a material pickup and discharging platform, a support column, a guide rod, and an infrared ranging sensor, wherein the material pickup and discharging platform is located at a top of one side of the rack, the installation seat is arranged on a bottom of the material pickup and discharging platform separately, the jacking device is arranged at a bottom of the installation seat of the material pickup and discharging platform, the positioning column corresponding to a position of the jacking device is inserted into each of two sides of a top of the material pickup and discharging platform separately, and an output end of the jacking device and a bottom of the positioning column are connected.

2. The positioning mechanism according to claim 1, wherein the guide rod is arranged on a periphery of the bottom of the material pickup and discharging platform, the support column is arranged on each of two ends of the material pickup and discharging platform separately, and a guide hole corresponding to the guide rod is formed at a top of the support column and a top of the material pickup and discharging platform separately.

3. The positioning mechanism according to claim 1, wherein an installation groove is formed at a top of the support column, the infrared ranging sensor is provided in the installation groove, and a cloth is placed on the material pickup and discharging platform at the positioning column.

4. The positioning mechanism according to claim 1, wherein a lead screw is arranged at the bottom of the material pickup and discharging platform, a screw block corresponding to the lead screw is threadedly sleeved on the lead screw, a servo motor is arranged at a bottom end of the lead screw, a drive shaft at a top of the servo motor is connected with a rotating shaft of the lead screw through an elastic coupling, a top of the lead screw is rotatably connected with the bottom of the material pickup and discharging platform through a bearing, and the servo motor and the screw block are fixedly connected with the rack separately.

5. The positioning mechanism according to claim 1, wherein the jacking device is a pneumatic push rod or a hydraulic push rod.

6. A working method of the positioning mechanism according to claim 1, comprising the following specific steps:

step I: placing the material pickup and discharging platform on the rack of buttonhole process equipment of an automatic hat-making production line, and then fixing and installing a servo motor and a screw block at an inner top of the rack;

step II: driving a lead screw to rotate through the servo motor to make the lead screw move up and down threadedly in the screw block to adjust a use height of the material pickup and discharging platform, wherein the material pickup and discharging platform is configured for a buttonhole processing of a cloth with various thickness specifications;

step III: electrically connecting an electrical signal output terminal of the infrared ranging sensor with a control host of the automatic hat-making production line, electrically controlling the jacking device and the servo motor by the control host, and calculating, by the control host, a ranging value transmitted by the infrared ranging sensor, wherein through a number of rotations of the lead screw driven by the servo motor, the material pickup and discharging platform is configured for accurately moving to a required processing height; and step IV: placing the cloth required for the buttonhole processing on a side of the positioning column of the material pickup and discharging platform, and driving the positioning column to perform a jacking action by the jacking device before a material discharging, wherein the positioning column is jacked up, the cloth is inserted into the positioning column, and a positioning is completed to increase a precision of an embroidered eye.

7. The working method according to claim 6, wherein in the positioning mechanism, the guide rod is arranged on a periphery of the bottom of the material pickup and discharging platform, the support column is arranged on each of two ends of the material pickup and discharging platform separately, and a guide hole corresponding to the guide rod is formed at a top of the support column and a top of the material pickup and discharging platform separately.

8. The working method according to claim 6, wherein in the positioning mechanism, an installation groove is formed at atop of the support column, the infrared ranging sensor is provided in the installation groove, and the cloth is placed on the material pickup and discharging platform at the positioning column.

9. The working method according to claim 6, wherein in the positioning mechanism, the lead screw is arranged at the bottom of the material pickup and discharging platform, the screw block corresponding to the lead screw is threadedly sleeved on the lead screw, the servo motor is arranged at a bottom end of the lead screw, a drive shaft at a top of the servo motor is connected with a rotating shaft of the lead screw through an elastic coupling, a top of the lead screw is rotatably connected with the bottom of the material pickup and discharging platform through a bearing, and the servo motor and the screw block are fixedly connected with the rack separately.

10. The working method according to claim 6, wherein in the positioning mechanism, the jacking device is a pneumatic push rod or a hydraulic push rod.

* * * * *